US007568979B2

(12) United States Patent
Arnold, Jr.

(10) Patent No.: US 7,568,979 B2
(45) Date of Patent: Aug. 4, 2009

(54) GOLF SWING TRAINING APPARATUS

(76) Inventor: John G. Arnold, Jr., 2621 E. 33rd St., Tulsa, OK (US) 74105

( * ) Notice: Subject to any disclaimer, the term of this patent is extended or adjusted under 35 U.S.C. 154(b) by 0 days.

(21) Appl. No.: 11/843,852

(22) Filed: Aug. 23, 2007

(65) Prior Publication Data

US 2009/0118026 A1 May 7, 2009

(51) Int. Cl.
*A63B 69/36* (2006.01)

(52) U.S. Cl. ..... 473/258; 473/227; 473/229; 473/274

(58) Field of Classification Search ..... 473/207, 473/208, 219, 226, 227, 229, 257, 258, 266, 473/271–277
See application file for complete search history.

(56) References Cited

U.S. PATENT DOCUMENTS

| | | | | |
|---|---|---|---|---|
| 3,415,523 | A | 12/1968 | Boldt | |
| 3,604,712 | A | 9/1971 | Prior et al. | |
| 3,614,108 | A | 10/1971 | Garten | |
| 4,211,418 | A * | 7/1980 | Oppenheimer | 473/258 |
| 4,261,573 | A * | 4/1981 | Richards | 473/229 |
| 4,326,718 | A * | 4/1982 | Kiehl | 473/209 |
| 4,449,708 | A | 5/1984 | Humphrey | |
| 4,513,972 | A | 4/1985 | Empie | |
| 4,521,023 | A | 6/1985 | Williams | |
| 4,659,084 | A | 4/1987 | Vuick | |
| 4,758,000 | A * | 7/1988 | Cox | 473/208 |
| 5,156,402 | A * | 10/1992 | Hart | 473/229 |
| 5,188,367 | A * | 2/1993 | Gipe et al. | 473/229 |
| D336,673 | S | 6/1993 | Ohly et al. | |
| 5,288,073 | A * | 2/1994 | Noel | 473/229 |
| 5,439,226 | A | 8/1995 | Luedtke | |
| 5,458,340 | A | 10/1995 | Jackson | |
| 5,474,299 | A | 12/1995 | Romano | |
| 5,634,858 | A | 6/1997 | Bellagamba | |
| 6,132,322 | A * | 10/2000 | Bonham | 473/208 |
| 6,364,786 | B1 | 4/2002 | Khano | |
| 6,402,632 | B2 | 6/2002 | Hope et al. | |
| 6,402,633 | B1 * | 6/2002 | Hsiung et al. | 473/219 |
| 6,595,865 | B2 | 7/2003 | Stitz | |
| 6,783,464 | B1 | 8/2004 | Romano | |
| 7,150,683 | B2 | 12/2006 | Bender | |

* cited by examiner

*Primary Examiner*—Nini Legesse
(74) *Attorney, Agent, or Firm*—Head, Johnson & Kachigian

(57) ABSTRACT

A golf swing training apparatus. The apparatus includes a mounting bar with an extendable length arm stabilizer extending outwardly from the mounting bar and terminating in a headrest. A swing cam is rotatable around the arm stabilizer about an axis coaxial with the arm stabilizer. A guideline extends from the swing cam and terminates in a golf club connector so that the swing cam rotates with movement of the golf club. Additionally, a pair of adjustable length guide rods extends from the mounting bar.

13 Claims, 7 Drawing Sheets

10
22
26
46
42
50
44
39
30
38
48
32
34
20
40
60
36
24
70
28
80
84
88
82
86
90

GOLF SWING TRAINING APPARATUS

BACKGROUND OF THE INVENTION

1. Field of the Invention

The present invention is directed to a golf swing training apparatus having multiple adjustable functions to train a golfer in a proper golf swing throughout the entire swing path. In particular, the present invention provides a golf swing training apparatus with multiple adjustable functions including a head position or head restraint, a guideline attached to a golf club at one end and rotatable through a swing cam at the other end, and a pair of guide rods to restrain movement of a golf club through a golf swing.

2. Prior Art

The development of a proper golf swing is critical to becoming a successful golfer. A proper golf swing includes a number of components including maintaining a proper swing plane throughout the entire course of the golf swing. The back swing, down swing, ball contact, and follow through combine together to form a circular arc swing path. Repetitive practice of a golf swing is desirable so that a proper golf swing becomes second nature.

There are various known devices which train particular components of a golf swing. For example, a number of training devices assist in maintaining a head position of a golfer during a golf swing.

Various devices affix a cord or tensioning member to a golf club so that the golf club is tethered to a point during the golf swing. Other devices are tethered to a sliding carriage. Various other devices retain a head, legs, or arms during the course of a golf swing.

Prior patent references include Humphrey (U.S. Pat. No. 4,449,708) which discloses a golf practice device having a track 11 with a sliding carriage 15 attached to a flexible tension member connected to a golf club.

Khano (U.S. Pat. No. 6,364,786) discloses a golf swing training device having an arcuate guide shaft 21 held by a right support 22 and a left support. Club butt end 28 is affixed to a guide member 29 which passes through a ring.

Bellagamba (U.S. Pat. No. 5,634,858) discloses a golf trainer with a base frame 12 supporting telescoping arms 20 and 21 which terminate in a cap 25 to hold the head in place. An adjustable mirror 30 allows a golfer to see alignment. FIG. 12 shows an embodiment with a swing guide 193.

Boldt (U.S. Pat. No. 3,415,523) discloses a golf training device combining a head cap restraint 56 and a club holder 22 with a guide mechanism to restrain the path of a golf club.

Prior et al. (U.S. Pat. No. 3,604,712) discloses a practice swing guide including a rod 72 attached to a club at one end and a weighted opposed end.

Empie (U.S. Pat. No. 4,513,972) discloses an adjustable head movement restraining device.

Williams (U.S. Pat. No. 4,521,023) discloses a golf training device 10 with a rigid arm 14 terminating in a cap which can reciprocate by a compression spring 31.

Vuick (U.S. Pat. No. 4,659,084) discloses a golf swing training apparatus with a boom 15 carrying a pad 20 which bears against a golfer's head.

Jackson (U.S. Pat. No. 5,458,340) discloses a golf swing training device with an arm member 29 extending from a club. A line member 34 extends between a sling member 29 and a wall anchor.

Hope et al. (U.S. Pat. No. 6,402,632) discloses a golf swing training apparatus with a telescoping swing training arm connected to a vertical support by a universal joint. An opposite end is connected to a golf club shaft.

Stitz (U.S. Pat. No. 6,595,865) discloses a practice apparatus with a combination shoulder engaging guide 20, first telescoping rod 40 with a pad 44 to rest against the hands and a second telescoping rod 46 which engages a putter.

Bender (U.S. Pat. No. 7,150,683) discloses a golf swing training device for multiple movements including a head "freezer" apparatus directly in front of a golfer, an anti-lift pole that serves as a barrier to train the golfer not to lift his hands or arms, and a height adjustable rod 152 that serves as a barrier that does not allow the club head to travel back too far.

Nevertheless, there remains a need to provide a golf swing training apparatus having multiple adjustable functions that will assist in training the golfer to maintain a proper position during an entire golf swing.

There also remains a need to provide a golf swing training apparatus which may be easily mounted on a wall of a room, building, garage or basement.

There also remains a need to provide a golf swing training apparatus wherein its constituent elements may be folded away when not in use.

There also remains a need to provide a golf swing training apparatus which permits a golfer to choose from among a wide variety of training functions.

There also remains a need to provide a golf swing training apparatus which includes multiple training functions wherein each function is adjustable.

SUMMARY OF THE INVENTION

The present invention is directed to a golf swing training apparatus which includes multiple, adjustable functions. The golf swing training apparatus includes a mounting bar having a pair of opposed ends which terminate in wall brackets for attachment to a wall or elsewhere. The apparatus includes an extendible length arm stabilizer which extends from the mounting bar and terminates at one end at a head rest or head stabilizer.

The extendible length arm stabilizer may include a first tube that telescopes with respect to a second tube so that the position of the head stabilizer may be adjusted and locked in place.

The end of the arm stabilizer opposed to the head rest or head stabilizer is adjustably connected to the mounting bar to adjust the height of the arm stabilizer and adjust the rotational position of the arm stabilizer.

The apparatus also includes a swing cam which engages and rotates about a swing cam assembly mounted to the extendible length arm stabilizer through a shaft which passes through a diameter of the first tube of the arm stabilizer. A guideline attachment post extends radially outward from the swing cam. The swing cam may be engaged with the swing cam assembly through a series of bearings so that the swing cam and the attachment post may rotate around an axis of the arm stabilizer. The swing cam and swing cam assembly may also be adjusted by rotating the swing cam assembly about the shaft passing through the arm stabilizer. An adjustable length guideline is attached at one end of the guideline attachment post at a desired position on the attachment post.

An opposite end of the adjustable guideline is removably affixed to the golf club with a golf club connector such as a ring which slips over the end of the golf club.

The apparatus also includes a pair of extending guide rods which are each adjustable in length. At an opposite end of the guide rod, each guide rod is adjustably connected to a shaft which rotates within a guide rod mounting plate. The guide rods may each include gears which engage each other so that movement of one guide rod will cause movement of the other guide rod.

Finally, a swing tempo and angle check bar may be held by the golfer who will swing the bar through a simulated golf swing while positioning the golfer's head against the head restraint or head rest.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
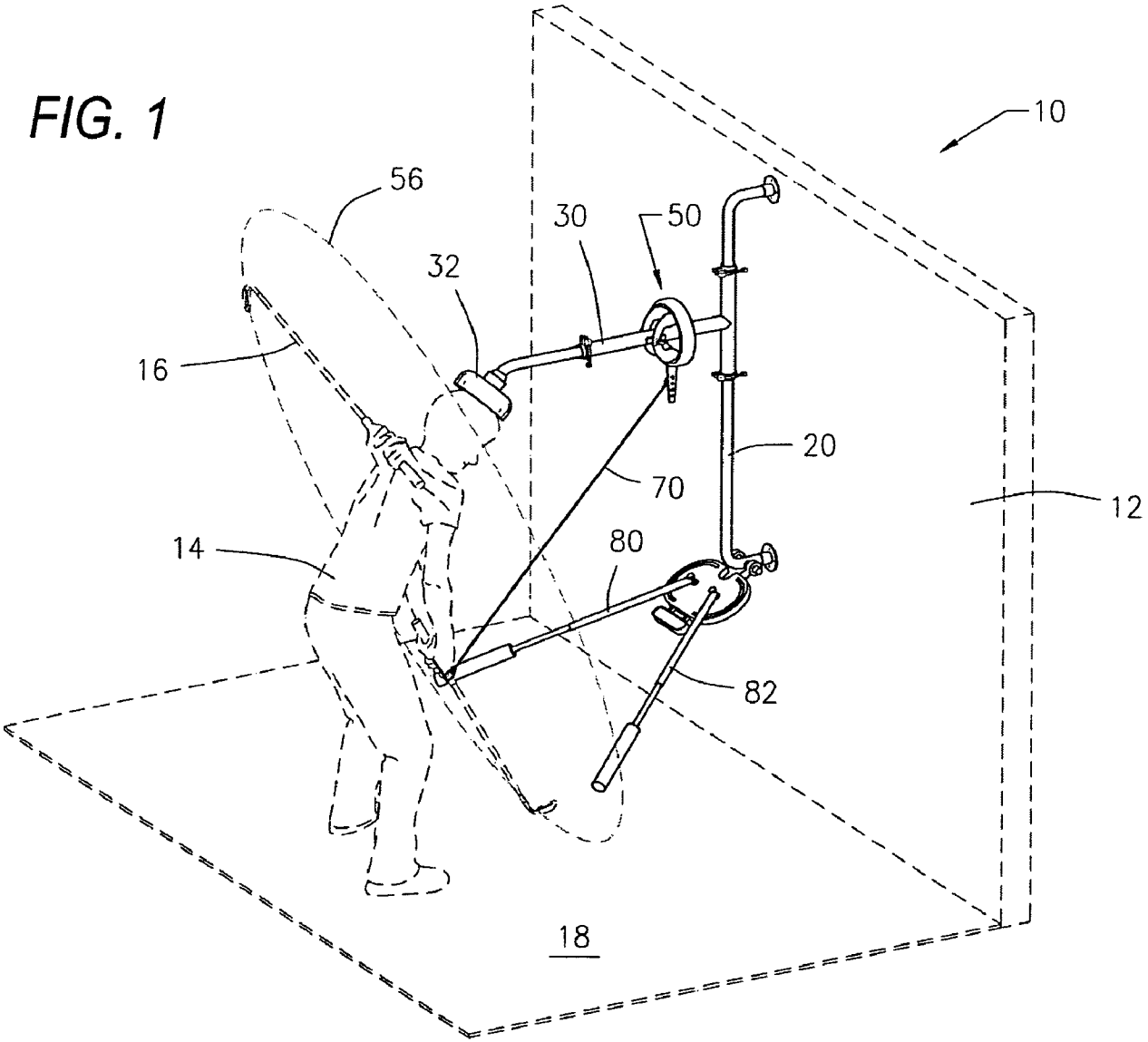
FIG. 1 illustrates a perspective view of a golf swing training apparatus constructed in accordance with the present invention mounted on a wall showing a golfer user in dashed lines swinging a golf club in dashed lines.

Referring to the drawings in detail, FIG. 1 illustrates a perspective view of a golf swing training apparatus 10 mounted on a wall 12 (shown in dashed lines) and also showing a golfer user 14 (shown in dashed lines) swinging a golf club 16 (shown in dashed lines) and standing on a floor 18. The swing plane is illustrated by dashed lines 56.

Figure 2:
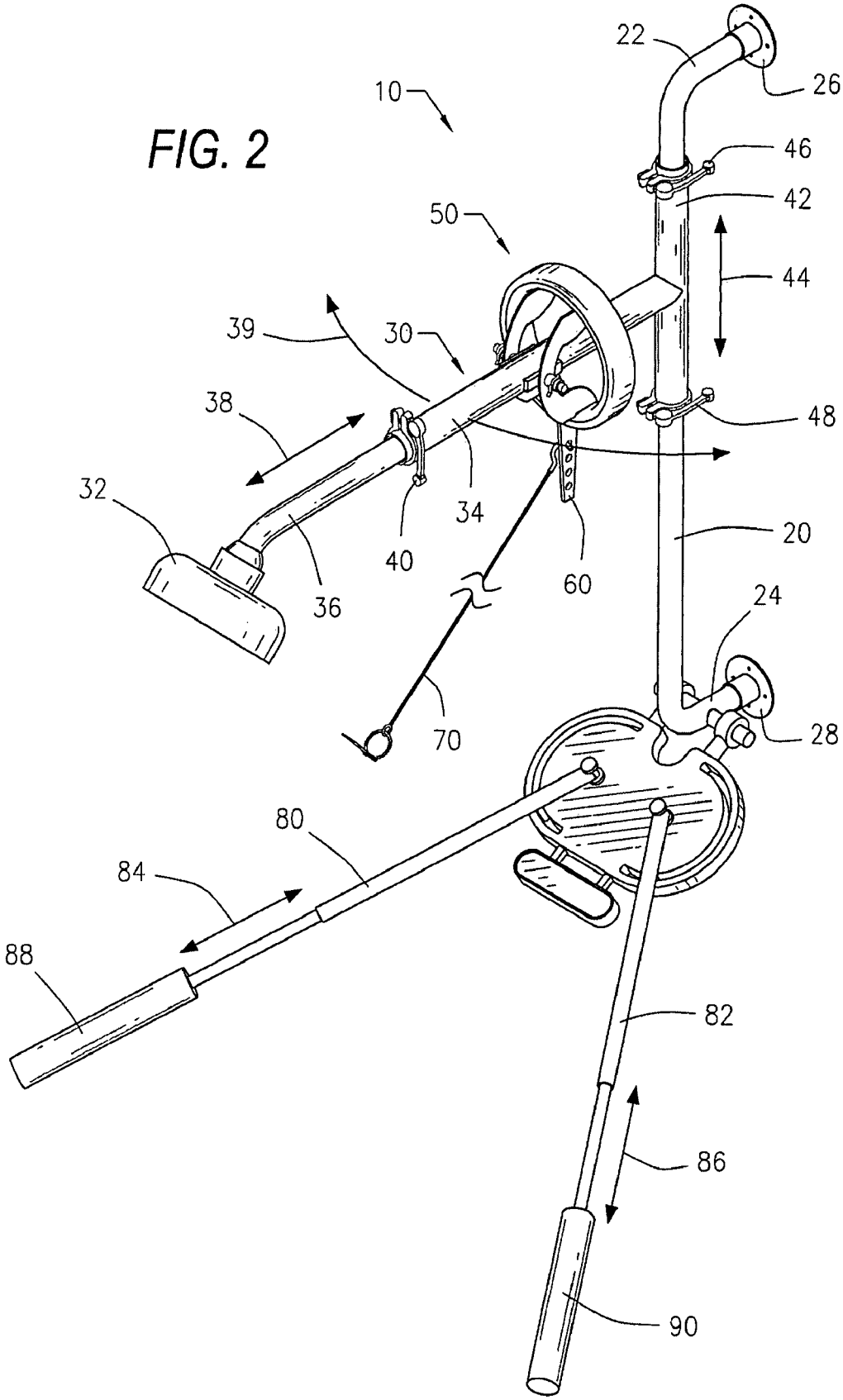
FIG. 2 illustrates a golf swing training apparatus shown in FIG. 1 with arrows showing the various positions of the elements.

FIG. 2 illustrates the golf swing training apparatus 10 shown in FIG. 1 alone with arrows showing the various positions of the constituent elements to be described in detail herein.

The apparatus 10 includes a tubular mounting bar 20 having a pair of opposed ends 22 and 24 which each terminate in a wall bracket 26 and 28, respectively, for attachment to a wall 12 by fasteners (not shown). It will be appreciated that other mechanisms for attachment of the mounting bar 20 might be employed within the spirit and scope of the present invention. Although the mounting bar 20 in a preferred embodiment is a hollow metal tube, other materials and configurations are possible.

As best seen in FIG. 1, when installed against a wall 12, the mounting bar 20 is substantially parallel to and spaced from the wall 12. In the configuration shown, the mounting bar 20 is also perpendicular to the floor 18. The mounting bar 20 may be fabricated from metal tubing. As will be described herein, the mounting bar remains stationary and affixed to the wall in all positions for both use and storage of the apparatus.

The apparatus 10 includes an extendible length arm stabilizer 30. The arm stabilizer 30 extends from the mounting bar 20 and terminates at one end in a headrest or head stabilizer 32 which may take a number of configurations. The extendible length arm stabilizer is substantially perpendicular to the mounting bar. The headrest may include a flat pad or, alternatively, might be in the form of a ball or sphere. The golfer user 14 will rest his or her head against the head stabilizer 32, to discourage unwanted movement of the head or body during the swing.

As best seen in FIG. 2, the extendible length arm stabilizer 30 may include a first tube 34 having a first diameter and a second tube 36 having an outside diameter slightly smaller than the inside diameter of the first tube so that the second tube 36 telescopes with respect to the first tube 34. Accordingly, the position of the head stabilizer 32 may be adjusted as illustrated by arrow 38. The length of the arm stabilizer may be locked into a desired position by a quick release collar 40 or other mechanism, as are well known.

The end of the arm stabilizer 30 opposed to the head stabilizer 32 is adjustably connected to the mounting bar 20. The first tube 34 is rigidly affixed to a tubular mounting sleeve 42 which has an inner diameter slightly larger than the outer diameter of the mounting bar 20. The mounting sleeve 42 is coaxial with the mounting bar. Accordingly, the mounting sleeve 42 and, in turn, the arm stabilizer 30, may be adjusted in height as illustrated by arrow 44. The tubular mounting sleeve 42 and the radially extending arm stabilizer 30 may also be radially adjusted as shown by arrows 39. The mounting sleeve 42 may be locked into a desired position by a pair of quick release collars 46 and 48, or other mechanisms, all as are well known.

Figure 6:
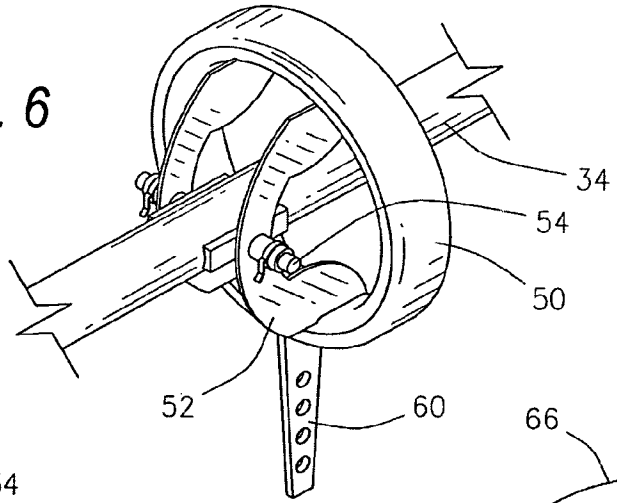
FIGS. 6, 7 and 8 illustrate alternate views of a swing cam and swing cam assembly of the golf swing training apparatus shown in FIG. 1.
Figure 7:
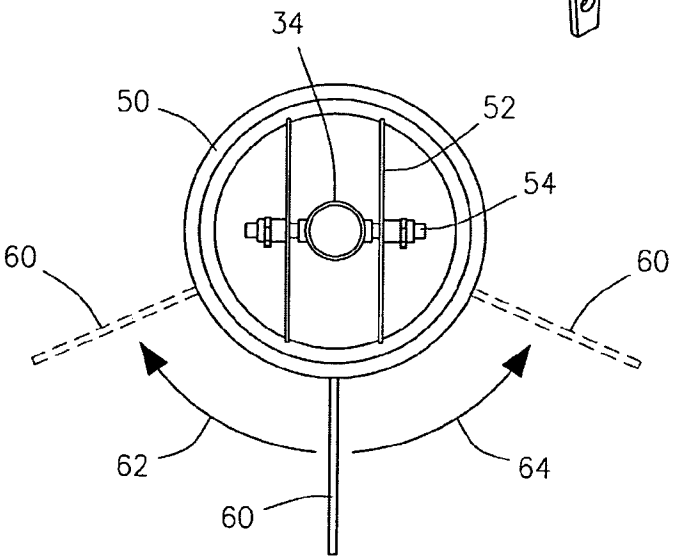
Figure 8:
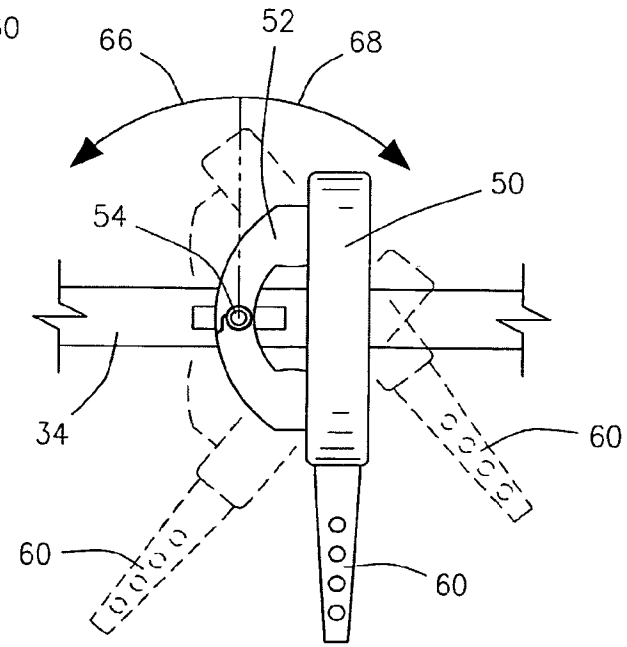

The apparatus 10 also includes a swing cam 50 shown in FIGS. 1 and 2 and also shown apart from the apparatus in FIGS. 6, 7, and 8. FIG. 6 illustrates a perspective view, FIG. 7 illustrates a front view, and FIG. 8 illustrates a side view of the swing cam. The swing cam 50 engages and rotates about a swing cam assembly 52 which is mounted to the first tube 34 of the extendable length arm stabilizer 30 through a shaft 54 which passes through a diameter of the first tube 34.

A guideline attachment post 60 extends radially outward from the swing cam 50. The swing cam 50 and the guideline attachment post 60 may be engaged with the swing cam assembly 52 through a series of bearings (not shown). Accordingly, the swing cam 50 and the attachment post 60 may rotate through 360° about an axis of the arm stabilizer 30 as illustrated by arrows 62 and 64 in FIG. 7.

The swing cam 50 and the swing cam assembly 52 may also be adjusted by rotating the swing cam assembly 52 about the shaft 54 passing through the arm stabilizer 30. As best seen in FIG. 8, the swing cam assembly 52 may be adjusted to adjust the angle of the swing cam 50 and the extending guideline attachment post 60 as illustrated by arrows 66 and 68. The angle of the swing cam assembly 52 will be set substantially parallel to the swing plane 56 of the golfer as shown in FIG. 1. The guideline attachment post 60 has a series of openings or apertures therethrough.

Figure 9:
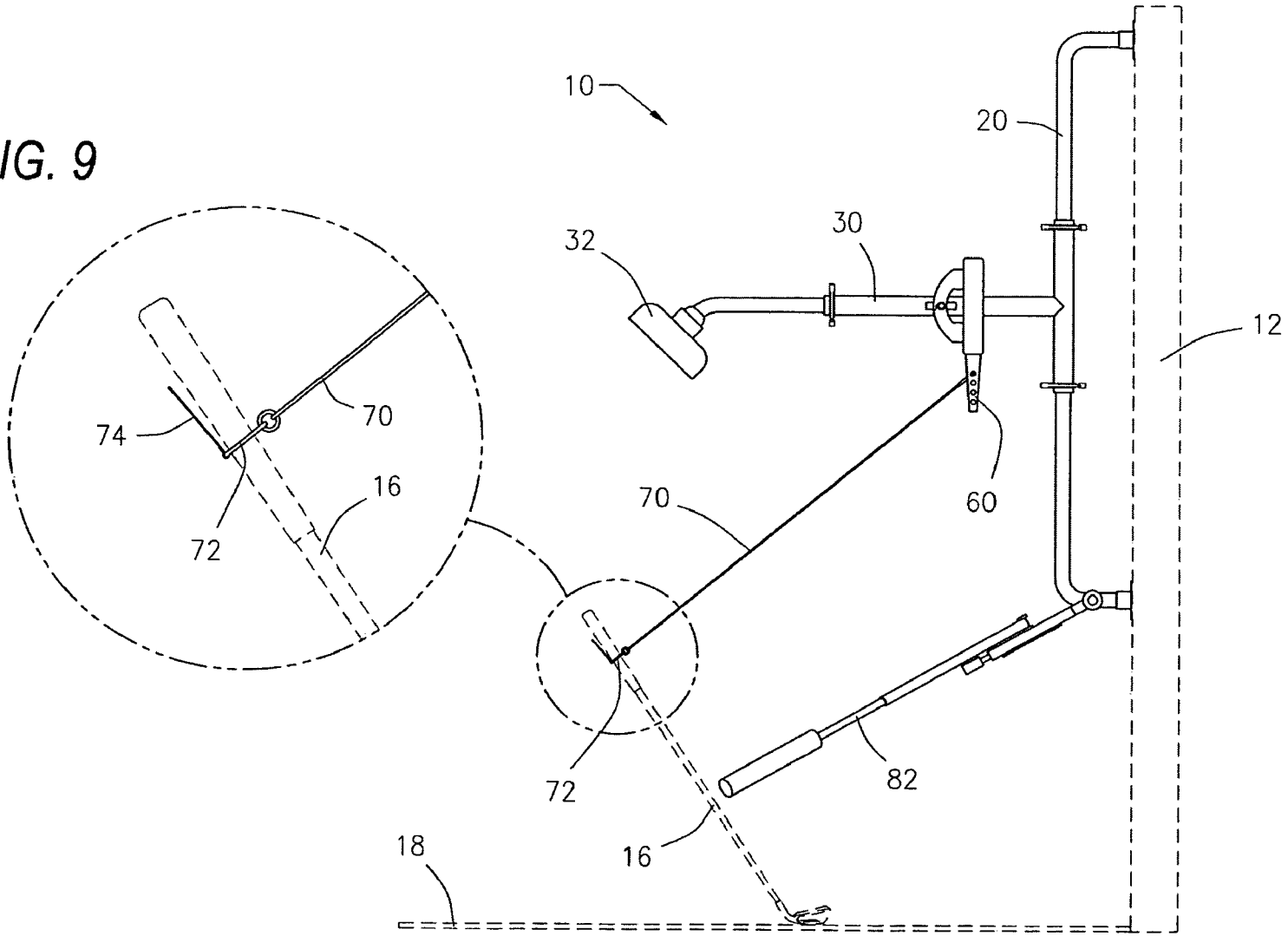
FIG. 9 illustrates a side view of the golf swing training apparatus shown in FIG. 1.

Returning to a consideration of FIG. 1 and also a side view of the apparatus 10 shown in FIG. 9, an adjustable length guideline 70, which may be a cord or a rope, is attached at one end to the guideline attachment post 60 at a desired location on the attachment post. The length of the guideline may be adjusted such as with a loop and a friction fit clamp. An opposite end of the guideline 70 is removably affixed to the golf club 16 with a golf club connector which may take a variety of configurations. In the preferred embodiment shown, the golf club connector includes a ring 72 which slips over the end of the golf club 16 and a tab 74 extending from the ring 72 which may be held by the golfer user 14 during the golf swing. The guideline 70 will not permit the golf club to be moved further than the length of the guideline. It will also act as a visual reminder to retain the guideline 70 in a taut position during the entire swing. Because the swing cam 50 and extending attachment post 60 will rotate, the guideline 70 will follow the entire swing path of the golf club during the golf swing.

Figure 4:
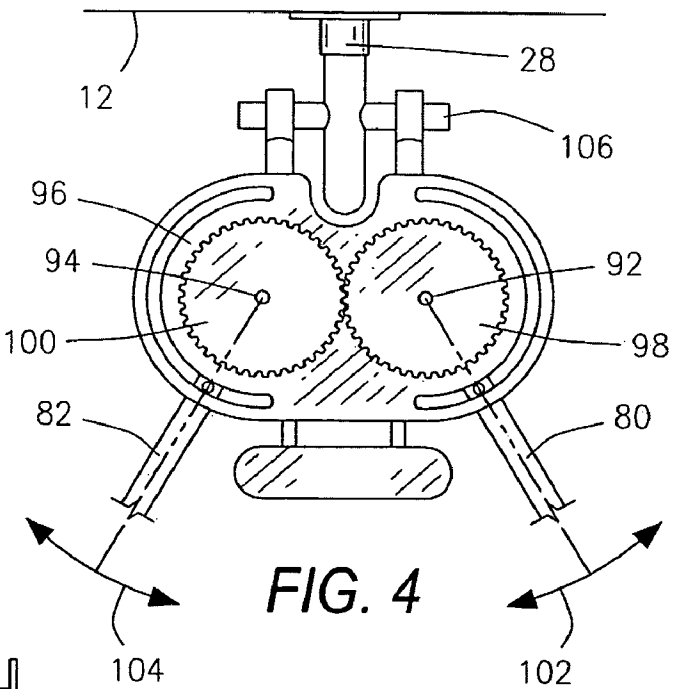
FIGS. 3, 4 and 5 illustrate alternate views of guide rods of the golf swing training apparatus shown in FIG. 1.
Figure 3:
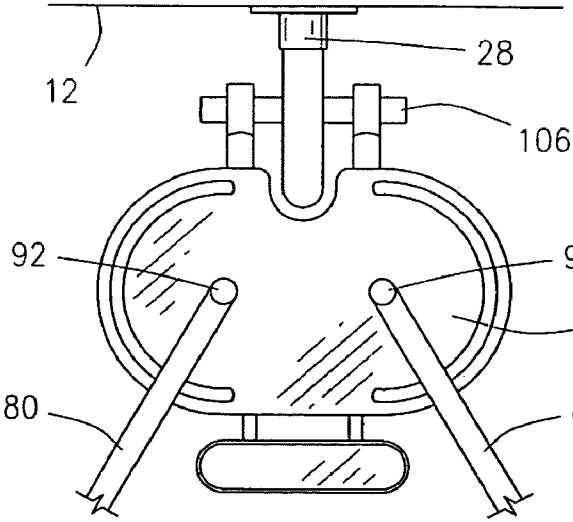
Figure 5:
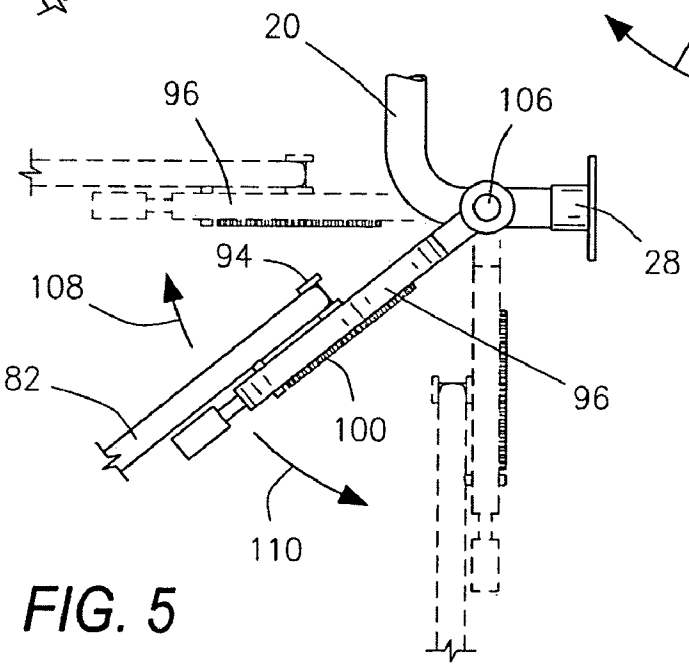

The apparatus 10 also includes a pair of extending guide rods 80 and 82 which are seen in FIGS. 1 and 2 and also shown in FIGS. 3, 4 and 5.

Each guide rod 80 and 82 is adjustable in length as illustrated by arrows 84 and 86, respectively, as shown in FIG. 2. Each guide rod 80 and 82 may terminate in a soft bumper 88 and 90, respectively. At an opposite end of each guide rod 80 and 82 from the bumpers, each guide rod is adjustably connected to a shaft 92 and 94 which rotates within a guide rod mounting plate 96 shown from the top in FIG. 3, from the bottom in FIG. 4, and from the side in FIG. 5. The guide rod 80 may also include a gear 98 while guide rod 82 may include a gear 100 which engage each other so that movement of one guide rod will cause movement of the other guide rod and so that the guide rods will stay equidistance from an angle formed by a plane through the mounting bar 20 perpendicular to the wall 12. The movement of the guide rods may be seen by the arrows 102 and 104 in FIG. 4. The mounting plate 96 also rotates with respect to the mounting bar 20 through a shaft 106 as best seen by the arrows 108 and 110 in FIG. 5.

Each guide rod 80 and 82 may include an extending pin that travels in an arc slot in or through the mounting plate 96.

Figure 10:
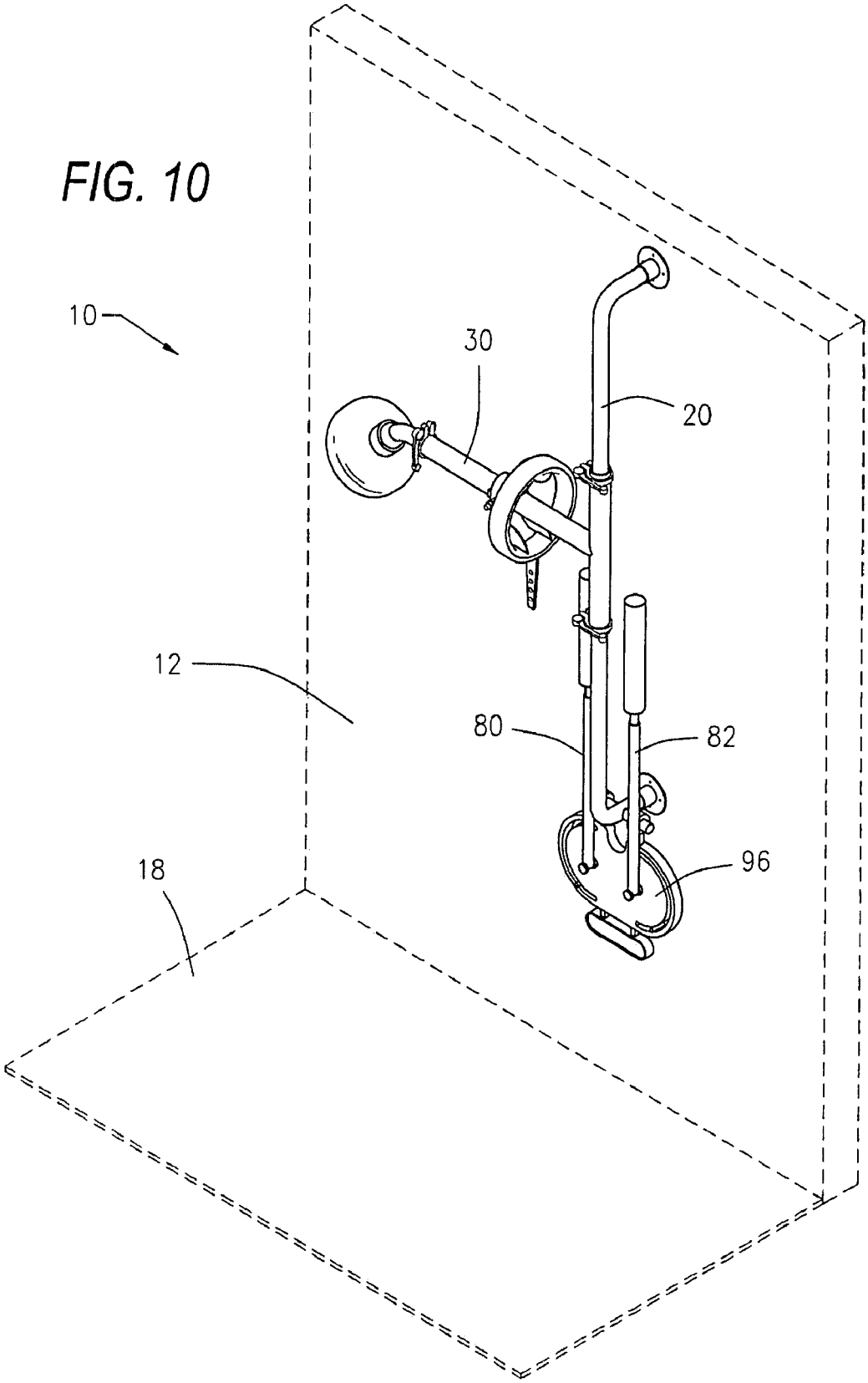
FIG. 10 illustrates a perspective view of the golf swing training apparatus shown in FIG. 1 which has been folded away for storage.

FIG. 10 illustrates a perspective view of the golf swing training apparatus which has been folded up after use for storage. The extendible arm stabilizer 30 has been rotated with respect to the mounting bar so it is adjacent to the wall 12.

Likewise, the guide rods 80 and 82 and the accompanying mounting plate 96 have been rotated with respect to the mounting bar 20 so that mounting plate 96 is parallel and adjacent to the wall and the guide rods 80 and 82 are parallel to and adjacent to the wall.

Figure 13:
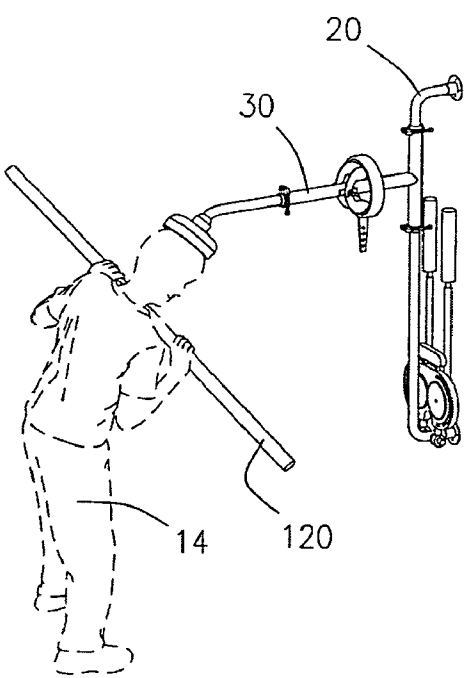
FIGS. 11, 12 and 13 illustrate alternate views of a tempo and angle check bar of the golf swing training apparatus of the present invention.
Figure 12:
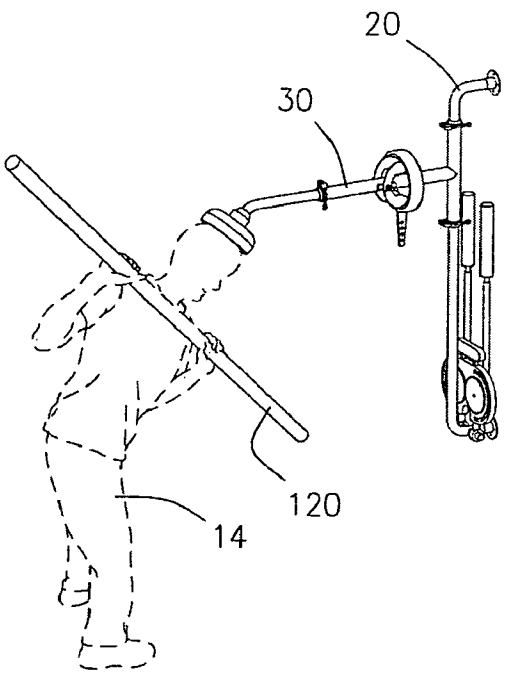
Figure 11:
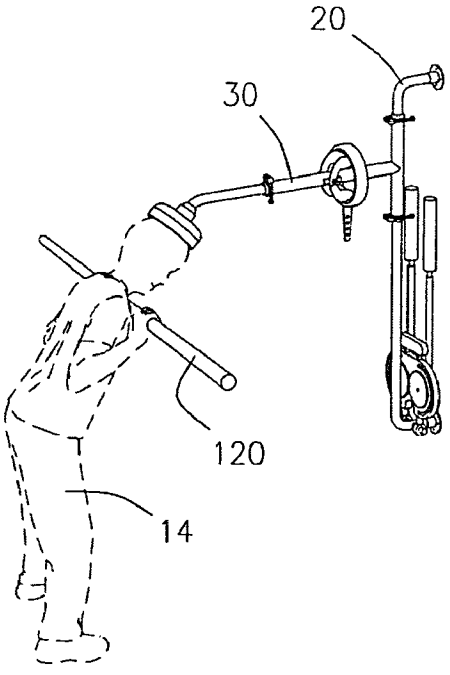

FIGS. 11, 12 and 13 illustrate a further, additional function of the golf swing training apparatus 10. With the extendible length arm stabilizer extending outward perpendicular from the wall (not shown in FIGS. 11, 12 and 13), the guide rods 80 and 82 would be rotated out of the way. The golfer 14 will hold at approximately chest level, a swing tempo and angle check bar while utilizing the head restraint or head rest 32 to position the head and body of the golfer. As shown in the sequential views in FIGS. 11, 12 and 13, the golfer will start with the bar 20 substantially parallel to the floor and then rotate the bar to simulate a back swing, down swing and follow through. The golfer will monitor the swing tempo and the swing angle of the bar throughout which encourages a smooth swing at a correct angle throughout.

Whereas, the present invention has been described in relation to the drawings attached hereto, it should be understood that other and further modifications, apart from those shown or suggested herein, may be made within the spirit and scope of this invention.

What is claimed is:

1. A golf swing training apparatus which comprises:

a mounting bar;

an extendable length arm stabilizer terminating in a headrest;

a swing cam rotatable around said arm stabilizer about an axis through said arm stabilizer;

an adjustable length guideline extending from said swing cam which terminates in a golf club connector; and a pair of guide rods extending from said mounting bar wherein said pair of guide rods each includes a gear having teeth which rotates with respect to each other.

2. A golf swing training apparatus as set forth in claim 1 wherein said mounting bar is tubular and is attachable to a wall so that said mounting bar is parallel to and spaced from said wall.

3. A golf swing training apparatus as set forth in claim 1 wherein said extendable length arm stabilizer includes a telescoping tube which may be locked in place at a chosen position.

4. A golf swing training apparatus as set forth in claim 1 wherein said extendable length arm stabilizer is rotatable about an axis through said mounting bar.

5. A golf swing training apparatus as set forth in claim 1 wherein said swing cam includes a radially extending guideline attachment post and wherein said guideline extends from said swing cam attachment post.

6. A golf swing training apparatus as set forth in claim 1 wherein said golf club connector includes a ring to be placed over a golf club.

7. A golf swing training apparatus as set forth in claim 1 wherein said guide rods are rotatably connected to a guide rod swing plate which extends from said mounting bar.

8. A golf swing training apparatus is set forth in claim 1 wherein said pair of guide rods are each adjustable in length.

9. A golf swing training apparatus as set forth in claim 1 including a swing tempo and angle check bar that may be held across a user's chest.

10. A golf swing training apparatus as set forth in claim 1 wherein said swing cam is positional with respect to said arm stabilizer so that an angle formed by a plane through such swing cam and said axis of said swing cam may be positioned in a desirable location.

11. A golf swing training apparatus which comprises:

a mounting bar parallel to and spaced from a wall;

means for a head rest for a user extending from said mounting bar;

swing cam means for permitting rotation of a swing cam about an arm stabilizer about an axis through said arm stabilizer;

an adjustable length guideline attached at a first end to said swing cam and attached at an opposite end to a golf club; and means to provide a barrier to prevent said golf club from straying from a proper swing path, said means to provide a barrier to prevent said golf club from straying from a proper swing path includes a guide rod assembly having a guide rod mounting plate rotatably connected to said mounting bar, a pair of guide rod posts, and a guide rod extending from each guide rod post.

12. A golf swing training apparatus as set forth in claim 11 including a swing tempo and angle check bar that may be held across said user's chest.

13. A golf swing training apparatus as set forth in claim 11 wherein said means for a headrest extends from a telescoping extendable length arm stabilizer.

* * * * *